United States Patent [19]

Bishop

[11] Patent Number: 4,869,412

[45] Date of Patent: Sep. 26, 1989

[54] APPARATUS FOR GUIDING, HOLDING OR MOVING LONGITUDINAL ELEMENTS

[76] Inventor: Bernard F. Bishop, 3801 N. Lowell Ave., Chicago, Ill. 60641

[21] Appl. No.: 237,097

[22] Filed: Aug. 29, 1988

[51] Int. Cl.[4] ..... B65H 20/36

[52] U.S. Cl. ..... 226/170; 226/171; 226/172

[58] Field of Search ..... 226/170, 171, 172

[56] References Cited

U.S. PATENT DOCUMENTS

| | | | |
|---|---|---|---|
| 2,561,497 | 7/1951 | Clark et al. | 226/170 X |
| 3,116,050 | 1/1961 | Herrmann | 226/170 |
| 4,274,574 | 1/1981 | Bishop | 226/170 |
| 4,343,422 | 8/1982 | Dabringhaus et al. | 226/170 X |

FOREIGN PATENT DOCUMENTS

| | | | |
|---|---|---|---|
| 458854 | 8/1949 | Canada | 226/170 |

*Primary Examiner*—John Petrakes
*Assistant Examiner*—Phillip Han
*Attorney, Agent, or Firm*—Robert J. Black

[57] ABSTRACT

Apparatus for advancing, belaying, or retracting a longitudinal element, such as a cable, by means of engagement with an endless belt driven by a reversible motor in a predetermined endless path geometrically formed to guide and constrain the belt in the path by means of camming action along and around a support element. The cable is free to enter the apparatus engaging the belt at either end of the support element, to be advanced, belayed, or retracted by the belt along this predetermined path.

29 Claims, 2 Drawing Sheets

APPARATUS FOR GUIDING, HOLDING OR MOVING LONGITUDINAL ELEMENTS

BACKGROUND OF THE INVENTION

1. FIELD OF THE INVENTION

The present invention relates to an apparatus for guiding, advancing, belaying, retracting or pushing an element of indeterminate length, such as webbing, rope, cable, chain, wire, etc., and more particularly to apparatus for such purpose employing an endless belt, chain, or other conveyance driven in a continuous geometric path around a support member such that the endless conveyance can travel in the continuous path without mobius twist.

2. BACKGROUND ART

Most of the existing traction devices for pushing, pulling or holding elongated elements with the advantage of force multiplication have many shortcomings. When the elongated element is stiff or contains glass fibers or instruments, existing capstan devices require a very large diameter drum to accommodate the element's minimum permissible bending radius. Should the element's outer covering be twist or wear sensitive, or should the surface finish be susceptive of deformation or degradation, as with towed streamers or fiber optic cable, the presently available capstan devices are of limited use because of the sliding that exists across the capstan drum face.

When the energy available to pull the elongated element is restricted, as in aircraft, spacecraft, watercraft, or robotic systems, most present capstan devices limit system function to accommodate capstan inefficiency. When the length to diameter aspect ratio is high due to installation restrictions, such as exist in aircraft, submarines and certain robotic installations, the presently available capstan devices far exceed the available space envelope.

One approach to this particular problem is set forth in my U.S. Pat. No. 4,274,574, which approached the problem of minimum bend radius and wear due to slippage at the drum, by utilizing a capstan inversion principle. The device taught in my prior patent, however, has a shortcoming of low belt life due to their mobius twist and a load induced longitudinal pendulum oscillation of the belts with a resultant helix angle change. This arrangement effectively causes a torsional stress on the elongated element. It is also quite difficult to manufacture the belts because of their mobius strip twisted construction. Functionally, such a mechanism is inefficient due to the multiplicity of pulleys, bearings and drive gears employed in the system and also presents rather low response time due to the inertia of the end plates, pulleys and gear assemblies employed. Earlier other devices employing somewhat similar techniques and also exhibiting similar problems are disclosed in U.S. Pat. Nos. 2,789,687 and 3,116,050.

Patents which recognize some of the problems recognized by the applicant, but nevertheless not exhibiting the satisfactory solutions that he has developed, include U.S. Pat. No. 4,343,422 which discloses a mechanical means of moving a web of material and deflecting the same at 90 degrees or 180 degrees. As taught by that patent a belt is employed to bend around two half tubes which are used to support rollers or balls. The belt slides then on its back surface on the outer cylinder and on its front surface on the inner surface. As disclosed, the belts employed in this patent teach the use of a back surface which may have grooves to help in maintaining its alignment. The grooves, however, are shown only on one side of the belt. Because of the nature of the design, a belt deflector or deflectors are employed to align the belt on the cylinder and elliptical shaped rollers and a groove of an exact dimension is employed to facilitate movement and overcome friction with a carrier belt employed to transport the carrier web.

A somewhat similar technique employing a single groove, single drum and single pulley device to provide accurate alignment of two finite length film strips through a relatively long path is disclosed in U.S. Pat. No. 2,561,497.

SUMMARY OF THE INVENTION

The present invention consists of apparatus useful for guiding, advancing, belaying or retracting an element of indeterminent length, such as webbing, rope, cable, chain, wire, etc., and more particularly concerned with the advancing, belaying or retracting of the element by means of contact or frictional engagement with an endless belt, chain or other conveyance driven in a continuous geometrically precise path around a support member. Force is imparted to the element to be advanced, belayed, retracted or pushed by contact friction, essentially in accordance with the capstan principle.

The endless belt, chain or other conveyance is guided in and constrained to a predetermined, continuous geometric camming path by a surface, track or groove included in the surface of a stationary or rotatable support member.

The path is formed to guide and constrain the endless belt and with it the element being advanced, by a camming action of the belt, causing it to seek the center of the path as it travels, rather than by physically forcing the endless belt to follow the path by action of restraining sidewalls, such as may be found with a groove or rut. The formed path would be generally helical in a sense that it is both axial and circumferential, but its camming action on the endless belt is its essential feature.

Included in the camming track or groove may be rollers or pulleys whose axes are arranged essentially normal to the continuous path or track around the support member. The element being advanced, belayed, retracted or pushed is in turn guided and constrained by contact with the endless belt, chain or other conveyance. The endless belt, chain or other conveyance is driven along the continuous camming track or path by a pulley, gear, capstan or other means. Compared to other devices for applying tension to elements of indeterminent length, such as wire, rope or cable, the present invention is of minimal size and weight with relation to the tension applied and only requires minimal bending and causes only minimal abrasion or deformation to the element being advanced, belayed or retracted.

The present invention also demonstrates reversibility with virtually immediate response to direction or speed change requirements. It also provides high efficiency with minimal power consumption and the ability to accommodate a variety of sizes and types of elements that need to be advanced, belayed or retracted without requiring a special adjustment or a change of components.

As noted, the present invention makes possible a device which has the force multiplying advantage of a capstan as well as being able to overcome the operational and functional deficiencies of prior mechanisms. As set forth in the present invention, the advancing material can be designed to enter and exit the device at various angles over a 540 degree spherical angle. Further, the device does not induce twist of the elongated element due to change of size or shape of the elongated element over its length. Likewise, the device does not require a mobius twist in the belt or other conveyance used to advance the elongated element. Also, differing from most conventional capstan devices, the elongated element does not slip across the belt or other conveyance with the present apparatus, thus permitting high coefficients of friction between the elongated element and the endless belt or other conveyance. As envisioned, the present apparatus can have as few as one moving part, the endless conveyance, excluding the drive motor. Because of low system inertia, the present device is able to change direction from advance to retract very quickly. Stress in the belt, chain or other conveyance is balanced to minimize component and elongated element life. The camming surface or track may be designed to impart higher or lower torsional force to accommodate torsional stiffness of both the conveyance or the elongated material being advanced, belayed and/or retracted.

The present invention is designed to provide an elongated material advancing device, guide or capstan which conveys the elongated material by means of contact with an endless belt or chain, which in turn is guided by a continuous camming surface formed along and around the supporting member. The continuous camming surface is so designed as to center and guide the endless belt or chain around and along the support member in a manner which balances stress across the width of the endless belt and the elongated member being conveyed so that the stresses in their outer fibers are equal. The defined path of the continuous conveying camming surface eliminates the need for a mobius twist belt construction and also increases the effective bend radius at the belt surface as a function of the radius of curvature of an elliptical projection. The camming guide path can be projected as a surface, groove, or by an intersecting plane of the outer diameter of rollers or pulleys on a drum whose axis or cam angle is equal to the helical angle component of the camming surface. The induced or reduced torsion of the endless belt or chain outer member is design controllable by changing the helical angle component of the camming surface.

The present design includes a provision for the camming guide path surface or camming pulleys to continue around either or both ends of the fixed support member, providing an endless, twistfree path for the endless conveying belt. Thus, it can be seen that the present invention provides means to allow the advancing material to enter and exit at various angles over a 540 degree spherical angle, unlike the classical capstan device where an advancing material exits normal to its drum axis or a linear capstan or traction device where an advancing material exits parallel to the axis.

Accordingly, it is an object of the present invention to provide an elongated material advancing device or guide which is small in size, has high response to directional change, uses energy with greater efficiency and applies a capstan multiplier. It is a further object of the present invention to provide an elongated material advancing device, guide or capstan which conveys the material by means of contact with an endless belt or chain which is guided by a camming surface along a predetermined endless path formed along and around a support member in such a manner that it can travel continuously in either direction.

DESCRIPTION OF THE PREFERRED EMBODIMENT

Figure 1:
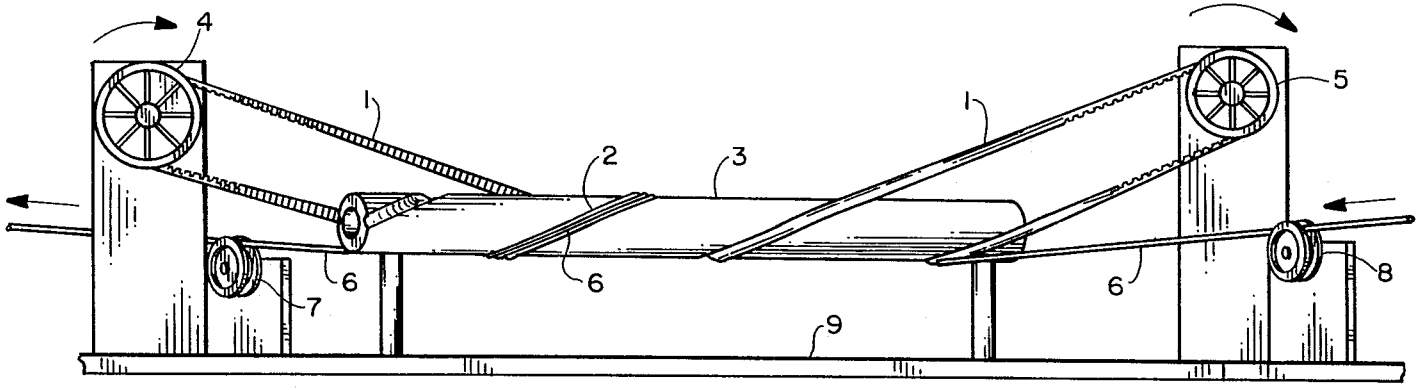
FIG. 1 is a side plan view of apparatus for guiding, holding or moving longitudinal elements in accordance with the present invention.
Figure 2:
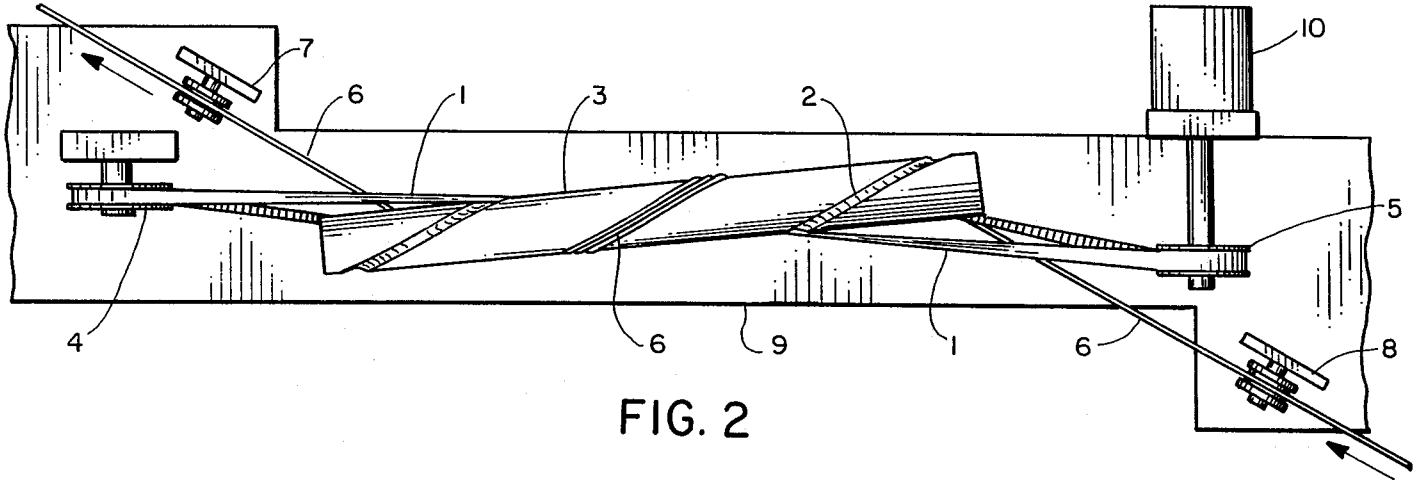
FIG. 2 is a top plan view of apparatus for guiding, holding or moving longitudinal elements in accordance with the present invention.

Referring now to FIG. 1, an endless belt 1 is driven along and guided in a continuous camming path 2 formed on a non-rotating beam or drum 3 (in an alternate embodiment it may rotate), by a rotating pulley 5 attached to drive motor 10. As may be seen in FIG. 2, drive motor 10 is affixed to the frame 9. In turn, guides 7 and 8 determine the path of the elongated member 6 to be advanced, belayed or retracted as it enters and exits the apparatus in accordance with the present invention. The entire assembly of components 1 through 8 is in place on support frame 9 to provide structural reaction to the forces applied to the elongated member.

A further understanding of the present invention may be had by the following description of the operation taken in conjunction with the above noted drawings. To operate in the current embodiment of the invention, one end of the elongated member, which is to be guided, advanced, belayed, or retracted is inserted through either one of the guides 7 or 8 and then wrapped along the camming path 2 in contact with the endless belt 1 until it reaches and then exits via the other guide (7 or 8). Tension is then established in the elongated member assuring frictional transfer of force from the endless drive belt to the elongated member. The drive motor 10 is activated in either direction to drive the endless belt 1 along its camming path 2 thereby advancing or retracting the elongated member.

It should be noted that traction force is a function of the drive motor capability, the back tension of the elongated member, the number of wraps in the elongated member in contact with the endless drive belt, and the coefficient of friction and the strength of the drive belt itself. Belaying force, as when motion of the endless drive belt is prevented, is limited in the same manner. The rate of advance or retraction of the elongated member will be proportionate to drive motor revolutions per minute (RPM).

It should be noted that the traction force or tension applied to the elongated member or the rate of transfer or both can be held constant or varied as desired depending on the means of motor control applied and appropriate selection of a drive motor offering the desired operating characteristics. It is also to be understood that the elongated member can be fixed while allowing the invention to move along the elongated member, back and forth or up and down, to lift or transport leads.

Of primary importance in the present invention is the inclusion on the fixed element of a "bi-helical plane" surface. This is a surface generated by a line lying on a flat plane as this line progresses along the helical cord whereas the lines plane intersects the helical cords radius, while the plane is coincidentally at an angle equivalent to the helix angle, relative to the helical cord center axis.

The bi-helical plane surface functions to guide and self-align a belt, chain, tape or webbed material to provide the necessary camming action, with balanced stress across its width or it may be used in tandem to eliminate mobius twist of the material.

Such a bi-helical plane surface can be produced by casting, forming, machining or by extrusion. A bi-helical plane surface can be machined using a programable machine center or by using special machine attachments. Such attachments must make it possible to rotate and translate the material relative to the cutter or vice versa at such a rate as would define the camming angle. In addition, the cutter axis must be capable of adjustment to an angle equivalent to the helix angle, or its complement, relative to the material axis of rotation.

It has been determined that standard production equipment is not well suited for manufacture of a bi-helical plane, but a rotating table can be installed on a milling machine to generate such a camming plane. Since a mills axis are perpendicular, a camming plane parallel to the helical axes will be produced. Additional modification of the millhead angle will then be required to manufacture the bi-helical surface.

A standard lathe generates a helix at right angles to the axis of rotation when cutting acme or standard threads. Since the helical lead per revolution for belt and web control would be at an angle and of a high ratio, it is not considered very practical to machine a bi-helical surface by utilization of a lathe. A camming path can be formed by rolling a strip at a helix angle. Since rolling mills have parallel axis rolls, the plane formed is a right helical plane which is parallel to the helix axis and therefore does not have the self-aligning feature of the bi-helical surface as defined in the present invention.

Figure 3:
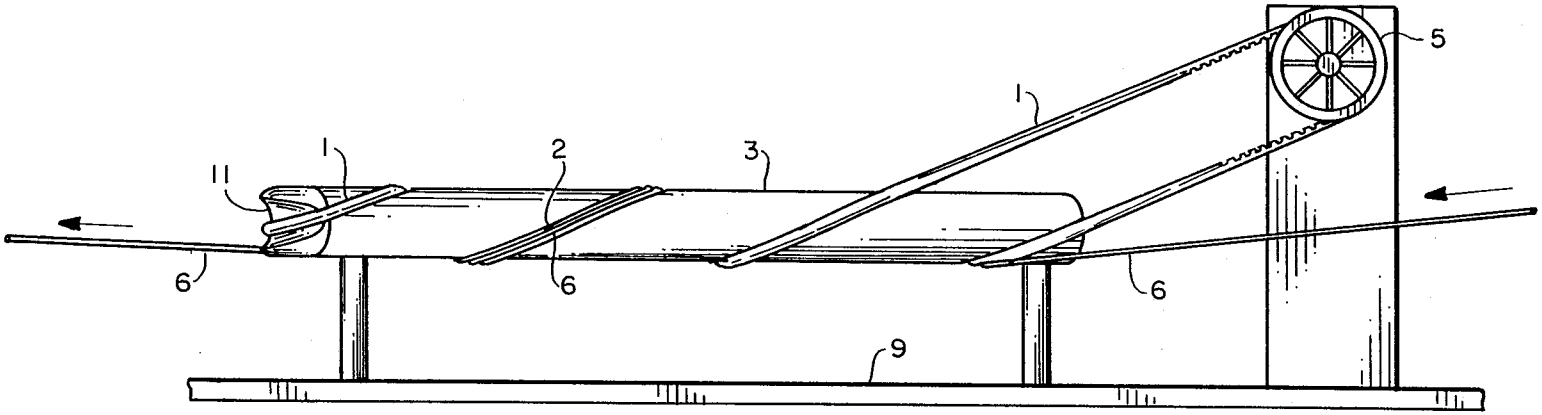
FIG. 3 is a perspective view of an alternate form of apparatus for guiding, holding or moving longitudinal elements in accordance with the present invention.
Figure 5:
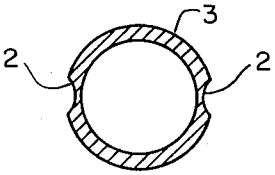
FIG. 5 is a sectional view of the support element taken along lines 5—5 of FIG. 4.
Figure 6:
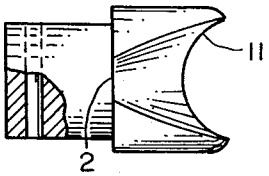
FIG. 6 is a side view of an end section for the support element as used in an alternate embodiment of the present invention.
Figure 7:
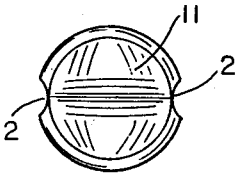
FIG. 7 is an end view of the end section of the support element used in an alternate form of the present invention.
Figure 4:
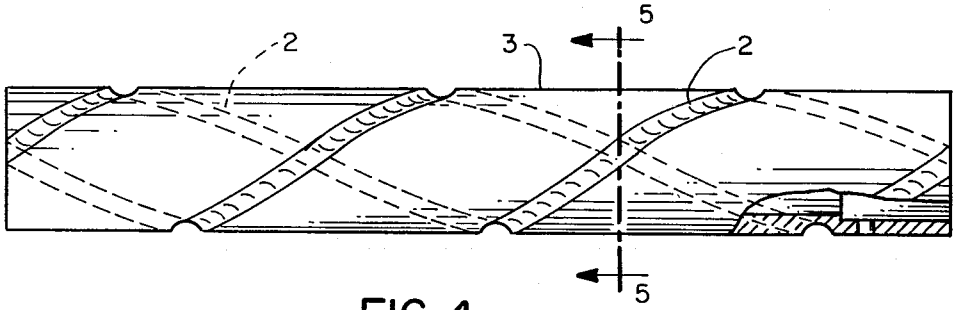
FIG. 4 is a partially sectionalized side view of a supporting element in accordance with the present invention showing the guide path sections in both positive and phantom form so as to provide a better understanding of their structure.

In an alternate form of the invention, shown in FIG. 3, the direction reversing pulley 4, shown in FIG. 1, is replaced with the end piece 11, shown in FIG. 3. This end piece is also shown in detail in FIGS. 6 and 7. As seen in FIG. 3, it can be used to replace the pulley and merely provides a continuation of the guide path sections located on the support element, allowing the belt of endless construction to rotate through the guide path section, over the end portion, back over the other guide path section, returning to the motive source of power or motor 10. It can be seen that by means of the foregoing implementation it is possible to reduce the number of moving parts, only the motive source of power being required in this alternate form of the invention.

While but only two embodiments of the present invention has been shown, it will be obvious to those skilled in the art that numerous modifications can be made without departing from the spirit of the invention which shall be limited only by the scope of the claims appended hereto.

What is claimed is:

1. Apparatus adapted to provide movement, or in the alternative to terminate movement, of a longitudinal element, said apparatus comprising:

a source of motive power;

a support element;

a guide path extending about said support element;

a direction reversing means;

a medium of endless construction tracing a path from said power source via said guide path to said reversing means and from said reversing means via said guide path to said power source;

said medium of endless construction further adapted to engage said longitudinal element at a first location moving, or in the alternative terminating movement, of said longitudinal element over said guide path disengaging said element at a second location;

and guide means comprising a first guide, adapted to position said longitudinal element in contact with said medium of endless construction and a second guide adapted to remove said longitudinal element from contact with said medium of endless construction.

2. Apparatus as claimed in claim 1, wherein:

said guide path comprises first and second guide path sections.

3. Apparatus as claimed in claim 2, wherein:

said first guide path section and said second guide path section extend about said stationary element in a spaced-apart relationship.

4. Apparatus as claimed in claim 2, wherein:

said direction reversing means is positioned between said first and said second guide path sections.

5. Apparatus as claimed in claim 4, wherein:

said reversing means comprise a third guide path section extending from said first guide path section around an end of said supporting element to said second guide path section.

6. Apparatus as claimed in claim 4, wherein:

said direction reversing means comprise a pulley.

7. Apparatus as claimed in claim 2, wherein:

said first and second guide path sections each comprise a camming surface adapted to center and guide said medium of endless construction along said guide path.

8. Apparatus as claimed in claim 7, wherein:

said camming guide path is extended around an end of said support element to join said first camming guide path section to said second camming guide path section.

9. Apparatus as claimed in claim 2, wherein:

said electric motor is of the reversible type.

10. Apparatus as claimed in claim 1, wherein:

said support element is cylindrical in form.

11. Apparatus as claimed in claim 1, wherein:

said support element is stationary.

12. Apparatus as claimed in claim 1, wherein:

said support element is rotatable.

13. Apparatus as claimed in claim 1, wherein:

said medium of endless construction comprises a belt.

14. Apparatus as claimed in claim 13, wherein:

said belt is adapted to provide transfer of friction to said longitudinal element.

15. Apparatus as claimed in claim 10, wherein:

said belt is adapted to grip said longitudinal element in order to move, or in the alternative terminating movement of, said longitudinal element.

16. Apparatus as claimed in claim 1, wherein: said guide means are adjustable.

17. Apparatus as claimed in claim 1, wherein:

said first and second guides each comprise a pulley.

18. Apparatus as claimed in claim 1, wherein:

there is further included a frame adapted to support said source of motive power, said support element, and said direction reversing means.

19. Apparatus as claimed in claim 1, wherein:

said guide path comprises a camming surface adapted to center and guide said medium of endless construction along said guide path.

20. Apparatus as claimed in claim 19, wherein:

said camming guide path is projected on the surface of said support element.

21. Apparatus as claimed in claim 19, wherein:

said camming guide path comprises a plurality of grooves in said support element.

22. Apparatus as claimed in claim 19, wherein:

said camming guide path includes a plurality of rollers located in a plane perpendicular to said camming guide path.

23. Apparatus as claimed in claim 19, wherein:

said camming guide path includes a plurality of pulleys located in a plane perpendicular to said camming guide path.

24. Apparatus as claimed in claim 1, wherein:

said source of power comprises an electric motor equipped with a pulley.

25. Apparatus as claimed in claim 1, wherein: said path comprises a camming guide path for guiding said medium of endless construction about said support element, said camming guide path including:

a bi-helical plane surface projected on said support element, adapted to center and guide said medium of endless construction along said guide path.

26. Apparatus as claimed in claim 25, wherein:

said bi-helical plane surface comprises a surface generated by a line lying on a flat plane as said line progresses along a helical cord and the plane of said lines intersects the helical cord radius while said plane is coincidentally at an angle equivalent to the helix angle, relative to said helical cord center axis.

27. Apparatus as claimed in claim 25, wherein:

said camming guide path comprises at least one groove in said support element.

28. Apparatus as claimed in claim 25, wherein:

said camming guide path includes a plurality of rollers located in a plane perpendicular to said camming guide path.

29. Apparatus as claimed in claim 25, wherein:

said camming guide path includes a plurality of pulleys located in a plane perpendicular to said camming guide path.

* * * * *